US011673387B2

(12) United States Patent
Shimizu

(10) Patent No.: US 11,673,387 B2
(45) Date of Patent: Jun. 13, 2023

(54) LIQUID JET HEAD AND LIQUID JET RECORDING DEVICE

(71) Applicant: SII PRINTEK INC., Chiba (JP)

(72) Inventor: Takayuki Shimizu, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 17/085,086

(22) Filed: Oct. 30, 2020

(65) Prior Publication Data

US 2021/0129531 A1 May 6, 2021

(30) Foreign Application Priority Data

Nov. 1, 2019 (JP) ..... JP2019-200092

(51) Int. Cl.
*B41J 29/38* (2006.01)
*B41J 2/045* (2006.01)

(52) U.S. Cl.
CPC ..... *B41J 2/04588* (2013.01); *B41J 2/04581* (2013.01)

(58) Field of Classification Search
CPC ..... B41J 2/04588; B41J 2/04581
See application file for complete search history.

(56) References Cited

U.S. PATENT DOCUMENTS 6,409,295 B1 6/2002 Norigoe
2007/0030297 A1* 2/2007 Norigoe ..... B41J 2/04588 347/11

FOREIGN PATENT DOCUMENTS

EP 3127704 A1 2/2017
EP 3238941 A1 11/2017
JP 6-149863 B2 6/2017
WO WO 2015/152185 A1 10/2015

OTHER PUBLICATIONS

Extended European Search Report in Europe Application No. 20205231.2, dated Mar. 22, 2021, 9 pages.

* cited by examiner

*Primary Examiner* — Lam S Nguyen
(74) *Attorney, Agent, or Firm* — Crowell & Moring LLP

(57) ABSTRACT

There are provided a liquid jet head and so on capable of ensuring the ejection stability of the liquid even when jetting the liquid high in viscosity irrespective of the structure of the liquid jet head. The liquid jet head according to an embodiment of the present disclosure includes a plurality of nozzles, an actuator having a plurality of pressure chambers, and a drive section for applying a drive signal to the actuator. The plurality of pulses in the drive signal include at least one first pulse configured to expand the volume of the pressure chamber, and at least one second pulse configured to contract the volume of the pressure chamber, and the pressure in the pressure chamber changes with time including a plurality of extremal values in one cycle. First timing as expansion start timing of the volume of the pressure chamber by the first pulse and second timing as contraction start timing of the volume of the pressure chamber by the second pulse are adjacent to each other, and both of the first timing and the second timing are located in a period between two consecutive extremal values of the plurality of extremal values.

7 Claims, 10 Drawing Sheets

COMPARATIVE EXAMPLE 1

PRACTICAL EXAMPLE

| TYPE OF PULSE INCLUDED IN Sd | Wp1, Wp2 | Wp1e, Wp2e | (Wp1+Wp2) |
|---|---|---|---|
| p1 (FOR EXPANSION) | Wp1 =(0. 2AP～1. 0AP) | Wp1e =(0. 2AP～1. 0AP) | (2AP±0. 2AP) |
| p2 (FOR CONTRACTION) | Wp2 =(1. 0AP～1. 8AP) | Wp2e =(0. 5AP～3. 0AP) | |
FIG. 8
FIG. 9A
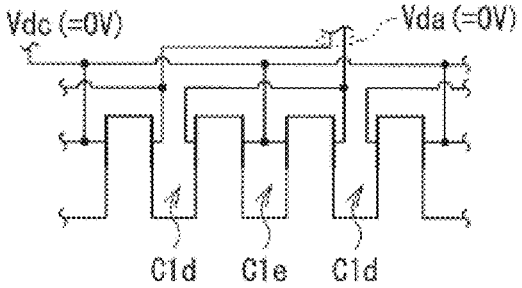
FIG. 9B
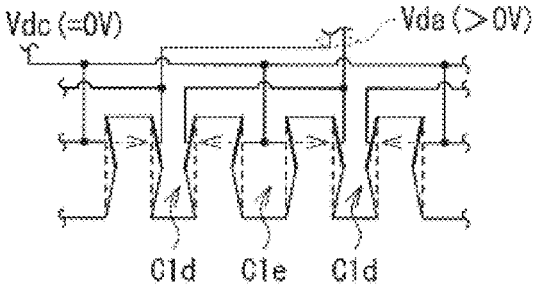
FIG. 9C
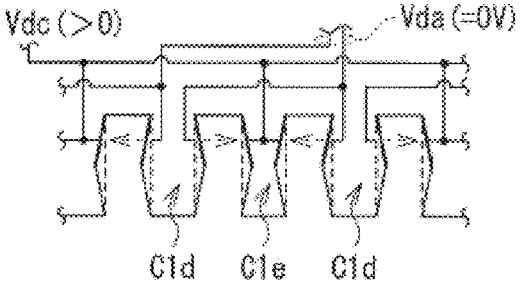

COMPARATIVE EXAMPLE 2

PRACTICAL EXAMPLE 1

PRACTICAL EXAMPLE 2

FIG. 11A

PRACTICAL EXAMPLE 3-1

| | Wp1 [AP] | Wp2 [AP] | EJECTION STABILITY |
|---|---|---|---|
| 2-DROP WAVEFORM | 1.6 | 0.4 | — |
| | 1.4 | 0.6 | — |
| | 1.2 | 0.8 | × (B) |
| | 1.0 | 1.0 | ○ (A) |
| | 0.8 | 1.2 | ○ (A) |
| | 0.6 | 1.4 | ○ (A) |
| | 0.4 | 1.6 | ○ (A) |

FIG. 11B

PRACTICAL EXAMPLE 3-2

| | Wp1 [AP] | Wp2 [AP] | EJECTION STABILITY |
|---|---|---|---|
| 3-DROP WAVEFORM | 1.6 | 0.4 | × (B) |
| | 1.4 | 0.6 | × (B) |
| | 1.2 | 0.8 | × (B) |
| | 1.0 | 1.0 | ○ (A) |
| | 0.8 | 1.2 | ○ (A) |
| | 0.6 | 1.4 | ○ (A) |
| | 0.5 | 1.5 | ○ (A) |
| | 0.4 | 1.6 | ○ (A) |
| | 0.3 | 1.7 | ○ (A) |

FIG. 11C

PRACTICAL EXAMPLE 3-3

| | Wp1 [AP] | Wp2 [AP] | EJECTION STABILITY |
|---|---|---|---|
| 5-DROP WAVEFORM | 1.4 | 0.6 | × (B) |
| | 1.2 | 0.8 | × (B) |
| | 1.0 | 1.0 | ○ (A) |
| | 0.8 | 1.2 | ○ (A) |
| | 0.6 | 1.4 | ○ (A) |
| | 0.5 | 1.5 | ○ (A) |
| | 0.4 | 1.6 | ○ (A) |
| | 0.2 | 1.8 | ○ (A) |

FIG. 12A

PRACTICAL EXAMPLE 4-1

| | Wp1 [AP] | Wp2 [AP] | EJECTION STABILITY |
|---|---|---|---|
| 5-DROP WAVEFORM | 1.6 | 1.0 | × (B) |
| | 1.4 | 1.0 | × (B) |
| | 1.2 | 1.0 | ○ (A) |
| | 1.0 | 1.0 | ○ (A) |
| | 0.8 | 1.0 | ○ (A) |
| | 0.6 | 1.0 | × (B) |
| | 0.5 | 1.0 | × (B) |
| | 0.4 | 1.0 | × (B) |
| | 0.3 | 1.0 | × (B) |

FIG. 12B

PRACTICAL EXAMPLE 4-2

| | Wp1 [AP] | Wp2 [AP] | EJECTION STABILITY |
|---|---|---|---|
| 5-DROP WAVEFORM | 1.0 | 1.6 | × (B) |
| | 1.0 | 1.4 | × (B) |
| | 1.0 | 1.2 | ○ (A) |
| | 1.0 | 1.0 | ○ (A) |
| | 1.0 | 0.8 | ○ (A) |
| | 1.0 | 0.6 | × (B) |
| | 1.0 | 0.5 | × (B) |
| | 1.0 | 0.4 | × (B) |

PRACTICAL EXAMPLE 5

| Wp2e [AP] | OFFSET VOLTAGE Vof (in AP) | EJECTION STABILITY |
|---|---|---|
| 0.25 | 6 | × (B) |
| 0.50 | 1 | ○ (A) |
| 0.75 | 0 | ○ (A) |
| 1.00 | 0 | ○ (A) |
| 1.25 | 0 | ○ (A) |
| 1.50 | 0 | ○ (A) |
| 1.75 | 0 | ○ (A) |
| 2.00 | 0 | ○ (A) |
| 2.25 | 0 | ○ (A) |
| 3.00 | 0 | ○ (A) |

FIG. 13

LIQUID JET HEAD AND LIQUID JET RECORDING DEVICE

RELATED APPLICATIONS

This application claims priority to Japanese Patent Application No. 2019-200092, filed on Nov. 1, 2019, the entire content of which is incorporated herein by reference.

BACKGROUND OF THE INVENTION

1. Field of the Invention

The present disclosure relates to a liquid jet head and a liquid jet recording device.

2. Description of the Related Art

Liquid jet recording devices equipped with liquid jet heads are used in a variety of fields, and a variety of types of liquid jet heads have been developed (see, e.g., International Patent Publication No. WO 2015/152185).

In such a liquid jet head, a liquid with viscosity no lower than, for example, 10 (mPa's) is used in some cases, but even in such a case, it is required to ensure ejection stability of the liquid irrespective of the structure of the liquid jet head.

Therefore, it is desirable to provide a liquid jet head and a liquid jet recording device capable of ensuring the ejection stability of the liquid even when jetting the liquid high in viscosity irrespective of the structure of the liquid jet head.

SUMMARY OF THE INVENTION

The liquid jet head according to an embodiment of the present disclosure includes a plurality of nozzles configured to jet liquid, an actuator having a plurality of pressure chambers communicated individually with the nozzles and each filled with the liquid, and a drive section configured to apply a drive signal having a plurality of pulses in one cycle to the actuator to thereby expand and contract a volume of the pressure chamber to jet the liquid filling the pressure chamber from the nozzle. The plurality of pulses in the drive signal include at least one first pulse configured to expand the volume of the pressure chamber, and at least one second pulse configured to contract the volume of the pressure chamber, and the pressure in the pressure chamber is made to change with time including a plurality of extremal values in the one cycle. Further, first timing as expansion start timing of the volume of the pressure chamber by the first pulse and second timing as contraction start timing of the volume of the pressure chamber by the second pulse are adjacent to each other, and both of the first timing and the second timing are located in a period between two consecutive extremal values of the plurality of extremal values with respect to the pressure in the pressure chamber.

The liquid jet recording device according to an embodiment of the present disclosure is equipped with the liquid jet head according to an embodiment of the present disclosure described above.

According to the liquid jet head and the liquid jet recording device related to an embodiment of the present disclosure, it becomes possible to ensure the ejection stability of the liquid even when jetting the liquid high in viscosity irrespective of the structure of the liquid jet head.

BRIEF DESCRIPTION OF THE DRAWINGS

FIG. 8 is a diagram showing an example of numerical ranges of pulse widths in a variety of pulses included in the drive signal.

FIGS. 9A through 9C are schematic diagrams showing an example of an operation state when performing common drive by the drive section.

FIGS. 11A through 11C are diagrams showing a relationship between a pulse width and an ejection stability related to Practical Examples 3-1 through 3-3, respectively.

FIGS. 12A and 12B are diagrams showing a relationship between a pulse width and an ejection stability related to Practical Examples 4-1, 4-2, respectively.

FIG. 13 is a diagram showing a relationship between a pulse width and an offset voltage, and ejection stability related to Practical Example 5.

DETAILED DESCRIPTION OF THE PREFERRED EMBODIMENTS

An embodiment of the present disclosure will hereinafter be described in detail with reference to the drawings. It should be noted that the description will be presented in the following order.

1. Embodiment (an example in which timing when the volume of a pressure chamber starts to change, and a pulse width of a drive signal are defined)
2. Modified Examples

1. Embodiment

[A. Overall Configuration of Printer 1]

Figure 1:
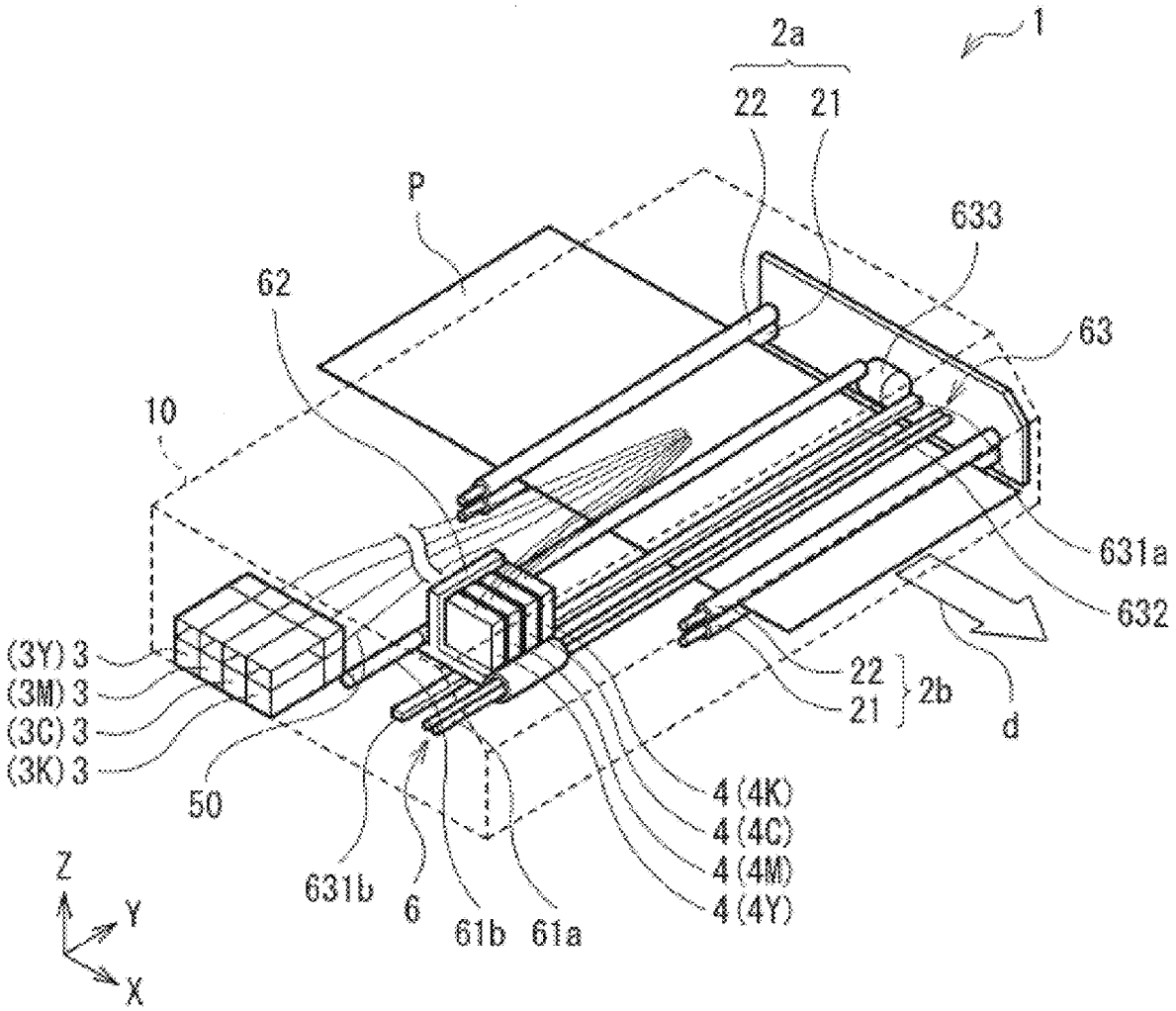
FIG. 1 is a schematic perspective view showing a schematic configuration example of a liquid jet recording device according to an embodiment of the present disclosure.

FIG. 1 is a perspective view schematically showing a schematic configuration example of a printer 1 as a liquid jet recording device according to an embodiment of the present disclosure. The printer 1 is an inkjet printer for performing recording (printing) of images, characters, and the like on recording paper P as a recording target medium using ink 9 described later. It should be noted that the recording target medium is not limited to paper, but includes a material on which recording can be performed such as ceramic or glass.

As shown in FIG. 1, the printer 1 is provided with a pair of carrying mechanisms 2*a*, 2*h*, ink tanks 3, inkjet heads 4, ink supply tubes 50, and a scanning mechanism 6. These members are housed in a chassis 10 having a predetermined shape. In the present embodiment, the description will be presented citing a non-circulation type inkjet head using the ink 9 without circulating the ink between the ink tanks 3 and the inkjet heads 4 as an example. It should be noted that this example is not a limitation, and it is possible to adopt, for example, a circulation type inkjet head using the ink 9 while being circulated between the ink tanks 3 and the inkjet heads 4. It should be noted that the scale size of each of the members is accordingly altered so that the member is shown large enough to recognize in the drawings used in the description of the specification.

Here, the printer 1 corresponds to a specific example of the "liquid jet recording device" in the present disclosure, and the inkjet heads 4 (inkjet heads 4Y, 4M, 4C, and 4K described later) each correspond to a specific example of the "liquid jet head" in the present disclosure. Further, the ink 9 corresponds to a specific example of the "liquid" in the present disclosure.

The carrying mechanisms 2*a*, 2*b* are each a mechanism for carrying the recording paper P along the carrying direction d (an X-axis direction) as shown in FIG. 1. These carrying mechanisms 2*a*, 2*b* each have a grid roller 21, a pinch roller 22 and a drive mechanism (not shown). This drive mechanism is a mechanism for rotating (rotating in a Z-X plane) the grid roller 21 around an axis, and is constituted by, for example, a motor.

(Ink Tanks 3)

The ink tanks 3 are each a tank for containing the ink 9 inside. As the ink tanks 3, there are provided four types of tanks for individually containing four colors of the ink 9, namely yellow (Y), magenta (M), cyan (C), and black (K), in this example as shown in FIG. 1. Specifically, there are disposed an ink tank 3Y for containing the yellow ink 9, an ink tank 3M for containing the magenta ink 9, an ink tank 3C for containing the cyan ink 9, and an ink tank 3K for containing the black ink 9. These ink tanks 3Y, 3M, 3C, and 3K are arranged side by side along the X-axis direction inside the chassis 10.

It should be noted that the ink tanks 3Y, 3M, 3C, and 3K have the same configuration except the color of the ink 9 contained, and are therefore collectively referred to as the ink tanks 3 in the following description.

(Inkjet Heads 4)

The inkjet heads 4 are each a head for jetting (ejecting) the ink 9 shaped like a droplet from a plurality of nozzles (nozzle holes Hn) described later to the recording paper P to thereby perform recording (printing) of images, characters, and so on. As the inkjet heads 4, there are also disposed four types of heads for individually jetting the four colors of ink 9 respectively contained in the ink tanks 3Y, 3M, 3C, and 3K described above in this example as shown in FIG. 1. Specifically, there are disposed the inkjet head 4Y for jetting the ink 9 as yellow ink, the inkjet head 4M for jetting the ink 9 as magenta ink, the inkjet head 4C for jetting the ink 9 as cyan ink, and the inkjet head 4K for jetting the ink 9 as black ink. These inkjet heads 4Y, 4M, 4C and 4K are arranged side by side along the Y-axis direction inside the chassis 10.

Figure 2:
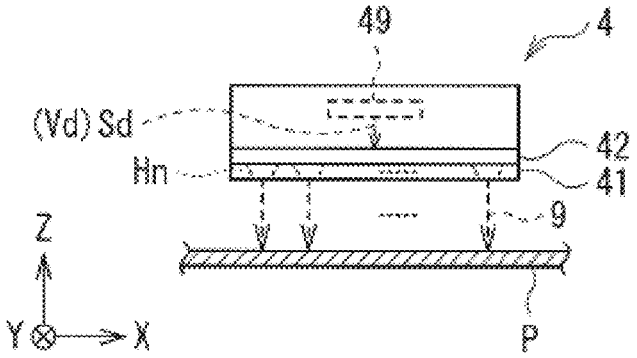
FIG. 2 is a schematic diagram showing a schematic configuration example of the liquid jet head shown in FIG. 1.
Figure 3:
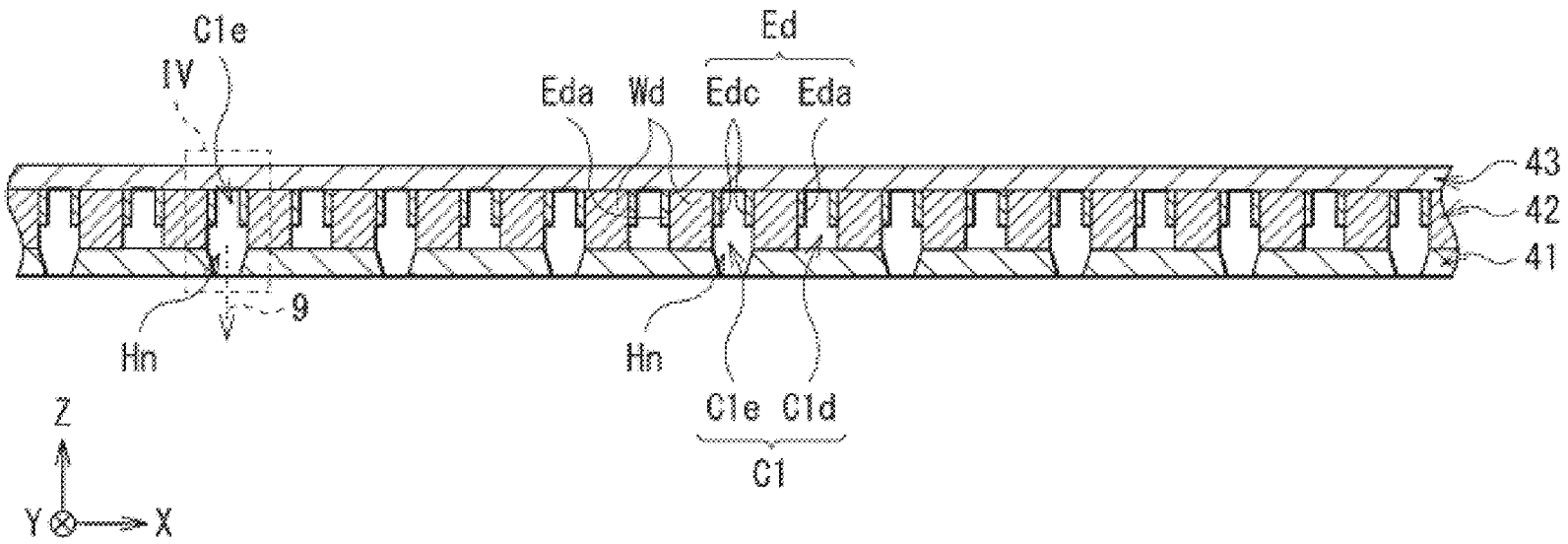
FIG. 3 is a schematic diagram showing a cross-sectional configuration example of the nozzle plate, the actuator plate, and so on shown in FIG. 2.
Figure 4:
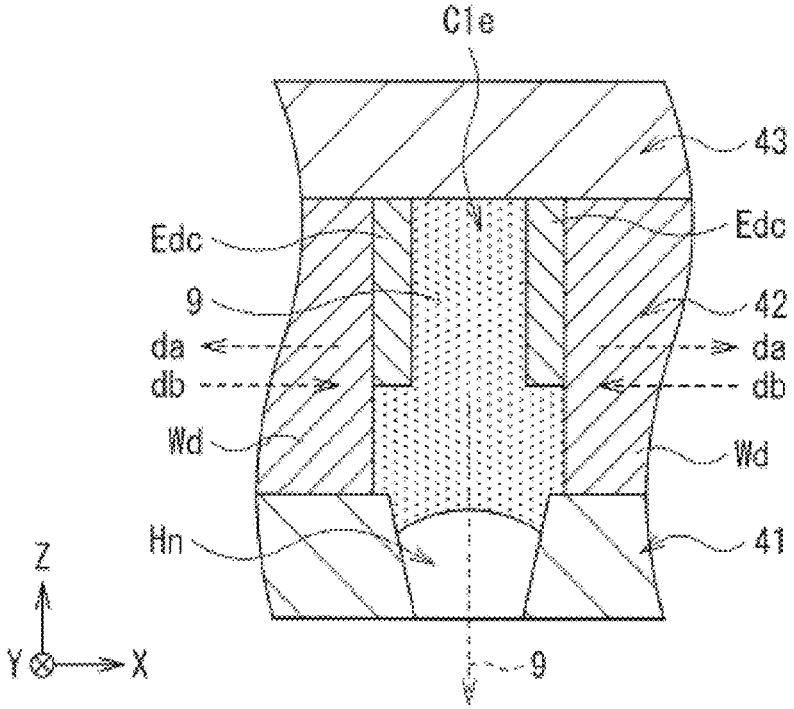
FIG. 4 is a schematic cross-sectional view showing, in an enlarged manner, the part IV shown in FIG. 3.

It should be noted that the inkjet heads 4Y, 4M, 4C and 4K have the same configuration except the color of the ink 9 used therein, and are therefore collectively referred to as the inkjet heads 4 in the following description. Further, the detailed configuration example of the inkjet heads 4 will be described later (FIG. 2 through FIG. 4).

The ink supply tubes 50 are each a tube through which the ink 9 is supplied from the inside of the ink tank 3 toward the inside of the inkjet head 4. The ink supply tubes 50 are each formed of, for example, a flexible hose having such flexibility as to be able to follow the action of the scanning mechanism 6 described below.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 61*a*, 61*b* disposed so as to extend along the Y-axis direction, a carriage 62 movably supported by these guide rails 61*a*, 61*b*, and a drive mechanism 63 for moving the carriage 62 along the Y-axis direction.

The drive mechanism 63 has a pair of pulleys 631*a*, 631*b* disposed between the guide rails 61*a*, 61*b*, an endless belt 632 wound between these pulleys 631*a*, 631*b*, and a drive motor 633 for rotationally driving the pulley 631*a*. Further, on the carriage 62, the four types of inkjet heads 4Y, 4M, 4C and 4K described above are arranged side by side along the Y-axis direction.

It should be noted that it is arranged that such a scanning mechanism 6 and the carrying mechanisms 2*a*, 2*b* described above constitute a moving mechanism for moving the inkjet heads 4 and the recording paper P relatively to each other. It should be noted that the moving mechanism of such a method is not a limitation, and, for example, it is also possible to adopt a method (a so-called "single-pass method") of moving only the recording target medium (the recording paper P) while fixing the inkjet heads 4 to thereby move the inkjet heads 4 and the recording target medium relatively to each other.

[B. Detailed Configuration of Inkjet Heads 4]

Next, the detailed configuration example of the inkjet heads 4 will be described with reference to FIG. 2 through FIG. 4.

FIG. 2 is a diagram schematically showing the schematic configuration example of each of the inkjet heads 4. FIG. 3 is a diagram schematically showing a cross-sectional configuration example (a Z-X cross-sectional configuration example) of a nozzle plate 41, a actuator plate 42, and so on shown in FIG. 2. FIG. 4 is a cross-sectional view (a Z-X cross-sectional view) schematically showing, in an enlarged manner, the part IV shown in FIG. 4.

The inkjet heads 4 are each an inkjet head of a so-called side-shoot type for ejecting the ink 9 from a central part in the extending direction (the Y-axis direction) of each of channels (channels C1) described later. As shown in FIG. 2 through FIG. 4, this inkjet head 4 has the nozzle plate 41, the actuator plate 42, a cover plate 43, and a drive section 49.

It should be noted that the nozzle plate 41, the actuator plate 42, and the cover plate 43 are bonded to each other using, for example, an adhesive, and are stacked (see FIG. 3 and FIG. 4) on one another in this order along the Z-axis direction. Further, it is also possible to arrange that a flow channel plate (not shown) having predetermined flow channels is disposed on an upper surface of the cover plate 43.

(B-1. Nozzle Plate 41)

The nozzle plate 41 is a plate formed of a film material such as polyimide, or a metal material, and has the plurality of nozzle holes Hn for jetting the ink 9 (see FIG. 2 through FIG. 4). These nozzle holes Hn are formed side by side in alignment (along the X-axis direction in this example) at predetermined intervals. It should be noted that each of the nozzles Hn is formed as a tapered through hole gradually decreasing in diameter in a downward direction (see FIG. 2 through FIG. 4).

It should be noted that such a nozzle hole Hn corresponds to a specific example of a "nozzle" in the present disclosure.

(B-2. Actuator Plate 42)

The actuator plate 42 is a plate formed of, for example, a piezoelectric material such as PLT (lead zirconate titanate). The actuator plate 42 is formed of a single (unique) piezoelectric substrate having the polarization direction set to one direction along the thickness direction (the Z-axis direction) (a so-called cantilever type). It should be noted that the configuration of the actuator plate 42 is not limited to the cantilever type. Specifically, it is possible to arrange that the actuator plate 42 is constituted by stacking two piezoelectric substrates different in polarization direction from each other on one another along the thickness direction (the Z-axis direction) (a so-called chevron type).

As shown in FIG. 3, the actuator plate 42 is provided with the plurality of channels C1. These channels C1 are arranged side by side along the X-axis direction so as to be parallel to each other at predetermined intervals. Each of the channels C1 is partitioned with drive walls Wd formed of a piezoelectric body, and forms a groove part having a recessed shape in a cross-sectional view (see FIG. 3). Although described later in detail, each of the drive walls Wd is arranged to function as an element (a piezoelectric element) for individually pressurizing the inside of each of the channels C1 (each of ejection channels C1*e* described later).

As shown in FIG. 3, in such channels C1, there exist the ejection channels C1*e* for ejecting the ink 9, and dummy channels (non-ejection channels) C1*d* not ejecting the ink 9. In other words, it is arranged that the ejection channels C1*e* are filled with the ink 9 on the one hand, but the dummy channels C1*d* are not filled with the ink 9 on the other hand. Further, it is arranged that each of the ejection channels C1*e* is communicated with the nozzle hole Hn in the nozzle plate 41 on the one hand, but each of the dummy channels C1*d* is not communicated with the nozzle hole Hn on the other hand. The ejection channels C1*e* and the dummy channels C1*d* are alternately arranged (see FIG. 3) along a predetermined direction (the X-axis direction in this example) inside the actuator plate 42 via the drive wall Wd described above.

It should be noted that the actuator plate 42 corresponds to a specific example of an "actuator" in the present disclosure, and the ejection channel C1*e* corresponds to a specific example of a "pressure chamber" in the present disclosure.

As described above, drive electrodes Ed are disposed on respective inside surfaces opposed to each other in the drive wall Wd as shown in FIG. 3. In other words, a pair of drive electrodes Ed are disposed so as to be opposed to each other across each of the drive walls Wd. As the drive electrodes Ed, there exist common electrodes Edc (common electrodes) disposed on the inside surfaces facing the ejection channel C1*e*, and individual electrodes Eda (active electrodes) disposed on the inside surfaces facing the dummy channels C1*d* (see FIG. 3, FIG. 4). In other words, the common electrodes Edc as the drive electrodes Ed are individually formed inside each of the ejection channels C1*e*, and the individual electrodes Eda as the drive electrodes Ed are individually formed inside each of the dummy channels C1*d*.

Such drive electrodes Ed and the drive circuit in the drive substrate (not shown) are electrically coupled to each other via a plurality of extraction electrodes provided to a flexible board (not shown). Thus, it is arranged that a drive voltage Vd (a drive signal Sd) and so on described later are applied to the drive electrodes Ed from the drive circuit including the drive section 49 described later via the flexible board.

(B-3. Cover Plate 43)

As shown in FIG. 3 and FIG. 4, the cover plate 43 is disposed so as to close the channels C1 in the actuator plate 42. Specifically, the cover plate 43 is bonded to the upper surface of the actuator plate 42, and has a plate-like structure.

(B-4. Drive Section 49)

As shown in FIG. 2, the drive section 49 is for performing ejection drive of the ink 9 using the drive signal Sd (the drive voltage Vd). On this occasion, the drive section 49 is arranged to output such a drive signal Sd (such a drive voltage Yd) based on a variety of types of data (signals) supplied from a printing control section (not shown) located inside the printer 1 (inside the inkjet head 4). Specifically, when the print data supplied from the printing control section is data for ejecting the ink 9, the drive section 49 generates the drive signal Sd based on the print data.

Then, the drive section 49 drives the actuator plate 42 so that the ink 9 filling the ejection channels C1*e* described above is ejected from the nozzle holes Hn to thereby perform the ejection drive (see FIG. 2 through FIG. 4). Specifically, the drive section 49 is arranged to apply the drive voltages Vd (the drive signals Sd) described above to the actuator plate 42 to expand and then contract the ejection channels C1*e* to thereby jet (make the actuator plate 42 perform the jetting operation) the ink 9 from the respective nozzle holes Hn.

[C. Detailed Configuration of Drive Voltage Vd and Drive signal Sd]

Next, the detailed configuration example of the drive voltage Vd and the drive signal Sd described above will be described with reference to FIG. 5 through FIG. 8.

Figure 5:
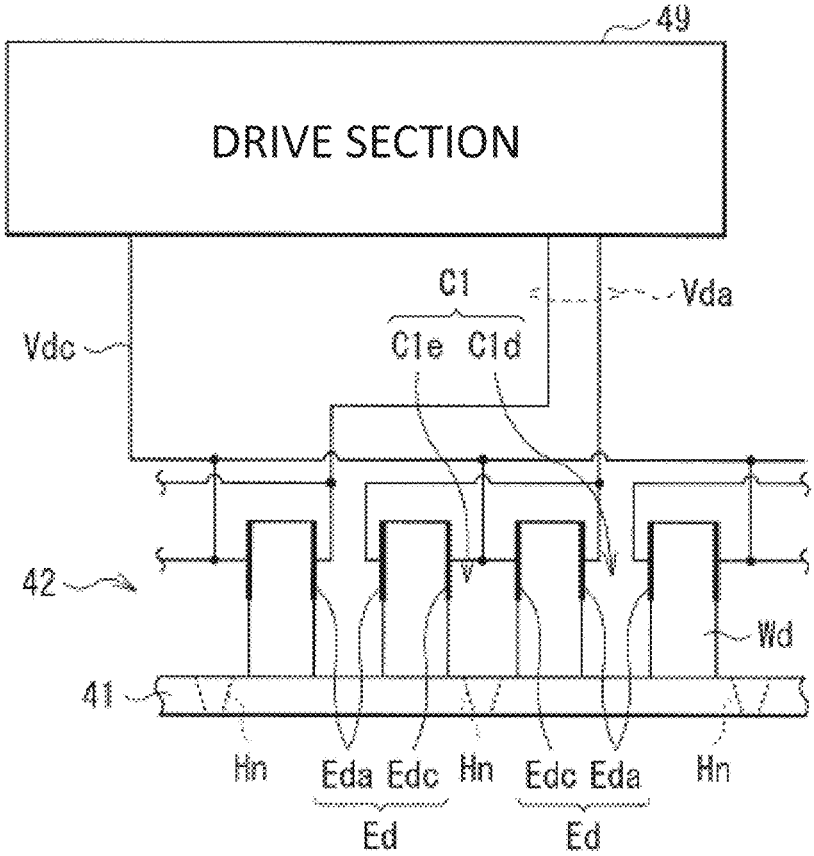
FIG. 5 is a schematic diagram showing a supply channel example of electrical potentials to be supplied from a drive section to drive electrodes.
Figure 6A:
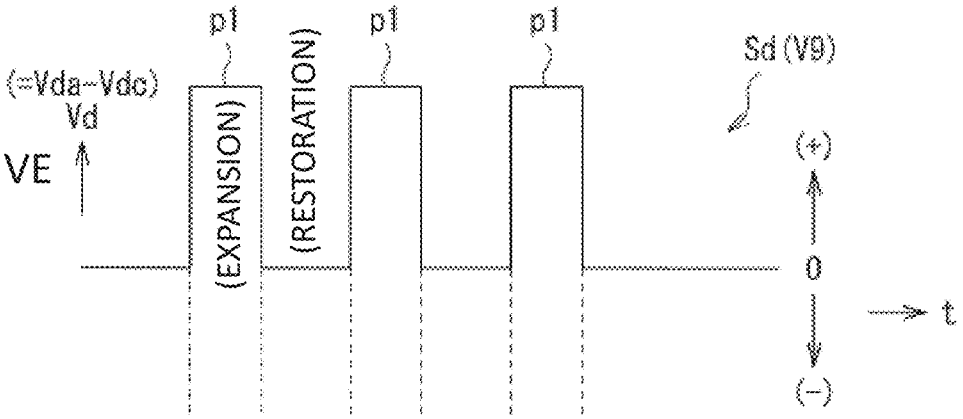
FIGS. 6A and 6B are timing charts schematically showing a waveform example of drive signals related to Comparative Example 1 and a practical example, respectively.
Figure 6B:
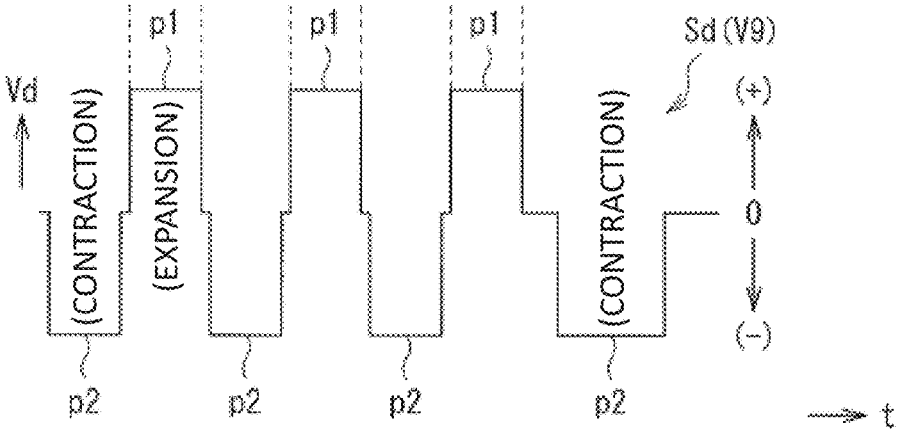

FIG. 5 is a diagram schematically showing supply channel examples of the electrical potentials supplied from the drive section 49 to the drive electrodes Ed (the individual electrodes Eda and the common electrodes Edc described above). Specifically, in FIG. 5, there are shown the supply channel examples regarding the electrical potentials (individual potentials Vda) supplied to the individual electrodes Eda and an electrical potential (a common potential Vdc) supplied to the common electrodes Edc, respectively. FIG. 6A and FIG. 6B are timing charts schematically showing waveform examples of the drive signals Sd related to Comparative Example 1 and a practical example, wherein FIG. 6A shows the waveform example of Comparative Example 1, and FIG. 6B shows the waveform example of the practical example related to the present embodiment. Further, FIG. 7A through FIG. 7D are timing charts schematically showing a variety of waveform examples of the drive signals Sd related to the practical example shown in FIG. 6B. FIG. 8 is a table collectively showing an example of numerical ranges of the pulse widths of a variety of pulses (an expansion pulse p1, a contraction pulse p2, and so on described later) included in the drive signals Sd.

It should be noted that in all of FIGS. 6A and 6B, and FIGS. 7A through 7D, the vertical axis represents a voltage value of the drive voltage Vd (corresponding to a potential difference between the individual potential Vda and the common potential Vdc: Vd=Vda−Vdc), and the horizontal axis represents time t. Further, the amplitude of such drive voltage Vd corresponds to a volume V9 of the ejection channel C1*e* described above, and when the drive voltage Vd has a positive (+) value and when the drive voltage Vd has a negative (−) value they respectively represent a state in which the volume V9 expands compared to a reference value and a state in which the volume V9 contracts compared to the reference value (see FIGS. 6A and 6B).

(C-1. Description of Common Drive)

First, with reference to FIG. 5 and FIGS. 6A and 6B, the "common drive" applied to the inkjet head 4 in the present embodiment will be described while being compared with Comparative Example 1 (the case of "uncommon drive").

First, in Comparative Example 1 (the case of uncommon drive) shown in FIG. 6A, the pulses of the drive signal Sd are set so that the volume V9 of the ejection channel C1*e* when ejecting the ink 9 exhibits changes including the expansion (the change toward the "+" side) compared to the reference value and restoration to the reference value. Specifically, the drive signal Sd in Comparative Example 1 is provided with a single expansion pulse p1 or a plurality of expansion pulses p1 (a plurality of expansion pulses p1 in this example) for expanding the volume V9 of the ejection channel C1*e* within one cycle (a drive period Td described later). Further, in the expansion pulse p1, the drive voltage Vd (=Vda−Vdc) corresponding to the potential difference between the individual potential Vda and the common potential Vdc is set so that Vd>0 (the potential difference described above has a positive value) becomes true.

In contrast, in the practical example (in the case of the common drive) shown in FIG. 6B, the pulses of the drive signal Sd are set so that the volume V9 of the ejection channel C1*e* when ejecting the ink 9 exhibits changes including the expansion compared to the reference value, the restoration to the reference value, and the contraction (the change toward the "−" side) compared to the reference value. Specifically, the drive signal Sd in the practical example is provided with a single contraction pulse p2 or a plurality of contraction pulses p2 (a plurality of contraction pulses p2 in this example) for contracting the volume V9 of the ejection channel C1*e* within one cycle in addition to the single expansion pulse p1 or the plurality of expansion pulses p1 (the plurality of expansion pulses p1 in this example) described above. Further, as described above, in the expansion pulse p1, the drive voltage Vd is set so that Vd>0 (the potential difference described above has the positive value) becomes true on the one hand, but in the contraction pulse p2, the drive voltage Vd is set so that Vd<0 (the potential difference described above has a negative value) becomes true on the other hand.

It should be noted that as described above in the example of the common drive shown in FIG. 6B, the common potential Vdc is set to a predetermined positive potential (Vdc>0) to thereby arrange that the drive voltage Vd (the potential difference between the individual potential Vda and the common potential Vdc) is set to a negative value (Vd<0), but this example is not a limitation. Specifically, it is also possible to arrange that, for example, the drive voltage Vd is directly set to a negative value (Vd<0) by setting the common potential Vdc to Vdc=0 (a ground potential), and at the same time, setting the individual potential Vda to a predetermined negative potential (Vda<0). Even in the case of such drive, it is possible to perform substantially the same drive (a pressure fluctuation in the actuator plate 42) as the common drive shown in FIG. 6B, and thus, the same applies to this case.

(C-2. Description of Detailed Waveforms of Various Pulses Included in Drive Signal Sd)

Then, detailed waveforms of a variety of pulses (the expansion pulse p1 and the contraction pulse p2 described above) included in the drive signal Sd in the case of the common drive described above will be described with reference to FIG. 7A through FIG. 7D.

The drive signal Sd in each of the examples shown in FIG. 7A through FIG. 7D is an example of a signal (a signal to which a so-called "multi-pulse method" is applied) having the plurality of expansion pulses p1 and the plurality of contraction pulses p2 within one cycle (the drive period Td described below). Further, in each of the examples shown in FIG. 7A through 7D, the first pulse and the last pulse out of the plurality of pulses in one cycle are both the contraction pulses p2 (but not the expansion pulses p1). It should be noted that the "one cycle (=the drive period Td)" means a time interval for forming one pixel (dot) on the recording target medium (the recording paper P).

Here, a drive frequency fd in the drive signal Sd shown in FIG. 7A through FIG. 7D is set as the reciprocal (fd=1/Td) of the drive frequency Td described above. Further, in other words, the drive frequency fd corresponds to the number of pixels (the number of dots) formed per second on the recording target medium.

It should be noted that hereinafter the last expansion pulse p1 in the drive period Td out of the plurality of expansion pulses p1 is particularly referred to as a final expansion pulse p1*e*. Similarly, hereinafter the last contraction pulse p2 in the drive period Td out of the plurality of contraction pulses p2 is particularly referred to as a final contraction pulse p2*e*. Further, as shown in FIG. 7A through FIG. 7D, the pulse widths of the expansion pulse p1, the contraction pulse p2, the final expansion pulse p1*e*, and the final contraction pulse p2*e* are hereinafter referred to as pulse widths Wp1, Wp2, Wp1*e*, and Wp2*e*, respectively. Further, as shown in FIG. 7A through FIG. 7D, the expansion start timing of the volume V9 of the ejection channel C1*e* due to the expansion pulse p1 is hereinafter referred to as expansion start timing t1. Similarly, the contraction start timing of the volume V9 of the ejection channel C1*e* due to the contraction pulse p2 is hereinafter referred to as contraction start timing t2. It should be noted that in all of FIG. 7A through FIG. 7D and FIG. 10A through FIG. 10C described later, only some of the expansion start timings t1 with respect to the plurality of expansion pulses p1 and only some of the contraction start timings t2 with respect to the plurality of contraction pulses p2 are illustrated for the sake of convenience.

Figures 7A, 7B, 7C, 7D:
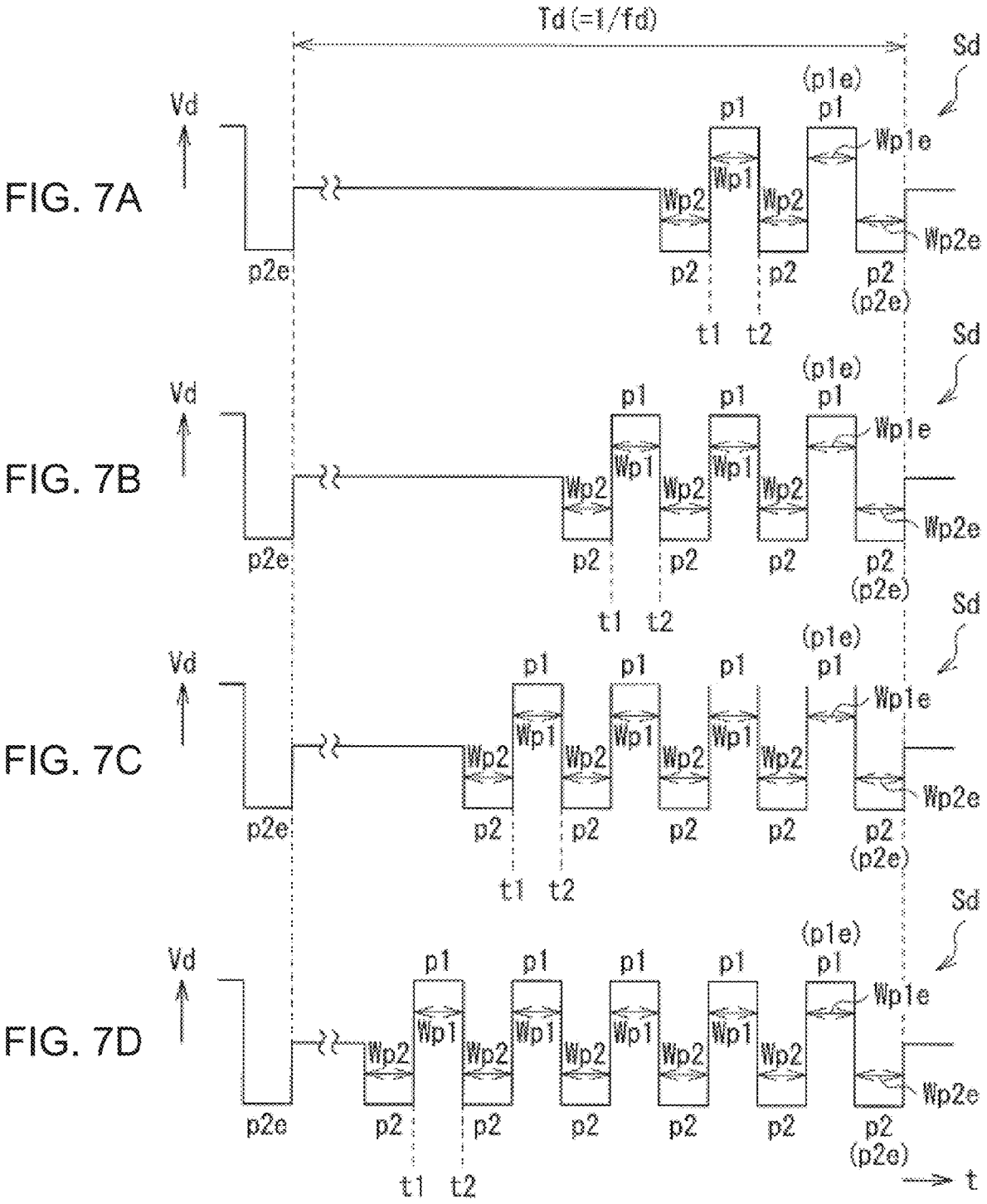
FIGS. 7A through 7D are timing charts schematically showing a variety of waveform examples in the drive signal related to the practical example shown in FIG. 6B.

First, the drive signal Sd shown in FIG. 7A has two expansion pulses p1 (and three contraction pulses p2) in the drive period Td described above to form an example of the case of so-called "two drops (2-drop)." Further, the drive signal Sd shown in FIG. 7B has three expansion pulses p1 (and four contraction pulses p2) in the drive period Td to form an example of the case of so-called "three drops (3-drop)." Similarly, the drive signal Sd shown in FIG. 7C has four expansion pulses p1 (and five contraction pulses p2) in the drive period Td to form an example of the case of so-called "four drops (4-drop)." The drive signal Sd shown in FIG. 7D has five expansion pulses p1 (and six contraction pulses p2) in the drive period Td to form an example of the case of so-called "five drops (5-drop)."

It should be noted that each of such an expansion pulse p1 (including the final expansion pulse p1*e* described above) and such a contraction pulse p2 (including the final contraction pulse p2*e* described above) corresponds to a specific example of a "plurality of pulses" in the present disclosure. Further, the expansion pulse p1 (including the final expansion pulse p1*e*) corresponds to a specific example of a "first pulse" in the present disclosure, and the contraction pulse p2 (including the final contraction pulse p2*e*) corresponds to a specific example of a "second pulse" in the present disclosure. Further, the final expansion pulse p1*e* corresponds to a specific example of a "final first pulse" in the present disclosure, and the final contraction pulse p2*e* corresponds to a specific example of a "final second pulse" in the present disclosure. Further, the expansion start timing t1 described above corresponds to a specific example of "first timing" in the present disclosure, and the contraction start timing t2 described above corresponds to a specific example of "second timing" in the present disclosure.

(C-3. Description of Numerical Ranges of Pulse Widths in Various Pulses)

Here, as shown in FIG. 8, in the inkjet heads 4 in the present embodiment, the pulse widths in the variety of pulses (the expansion pulse p1, the contraction pulse p2, the final expansion pulse p1*e*, and the final contraction pulse p2*e* described above) included in the drive signal Sd are respectively set within predetermined numerical ranges. Particularly, these pulse widths are each set in the predetermined numerical range based on the on-pulse peak (AP) in each of such pulses as described below in detail.

Incidentally, the AP corresponds to a period (1 AP=(characteristic vibration period of the ink 9)/2) half as large as the characteristic vibration period of the ink 9 in the ejection channel C1*e*. Further, when the pulse width of a certain pulse is set to the AP, the ejection speed (the ejection efficiency) of the ink 9 is maximized when ejecting (making one droplet ejection of) the ink 9 as much as one normal droplet. Further, the AP is arranged to be defined by, for example, the shape of the ejection channel C1*e* and a physical property value (the specific gravity or the like) of the ink 9.

Specifically, first, as shown in FIG. 8, the pulse width Wp1 (see FIG. 7A through FIG. 7D) in at least one expansion pulse p1 (an anterior-stage expansion pulse) other than the final expansion pulse p1*e* in the drive period Td is set within a range of 0.2 AP through 1.0 AP (0.2 AP≤Wp1≤1.0 AP). It should be noted that the anterior-stage expansion pulse (the expansion pulse p1 located in the anterior stage of the final expansion pulse p1*e* in the drive period Td) corresponds to a specific example of an "anterior-stage first pulse" in the present disclosure.

Further, as shown in FIG. 8, the pulse width Wp2 (see FIG. 7A through FIG. 7D) in at least one contraction pulse p2 (an anterior-stage contraction pulse) other than the final contraction pulse p2*e* in the drive period Td is set within a range of 1.0 AP through 1.8 AP (1.0 AP≤Wp2≤1.8 AP). It should be noted that the anterior-stage contraction pulse (the contraction pulse p2 located in the anterior stage of the final contraction pulse p2*e* in the drive period Td) corresponds to a specific example of an "anterior-stage second pulse" in the present disclosure.

Further, in the example shown in FIG. 8, the pulse width Wp1*e* (see FIG. 7A through FIG. 7D) in the final expansion pulse p1*e* described above is set within a range of 0.2 AP through 1.0 AP (0.2 AP≤Wp1*e*≤1.0 AP).

In addition, in the example shown in FIG. 8, the pulse width Wp2*e* (see FIG. 7A through FIG. 7D) in the final contraction pulse p2*e* described above is set within a range of 0.5 AP through 3.0 AP (0.5 AP≤Wp2*e*≤3.0 AP).

Further, in the example shown in FIG. 8, the combined value (=Wp1+Wp2) of the pulse widths Wp1, Wp2 described above is set within a range of (2 AP±0.2 AP).

Further, in the present embodiment, when there are three or more expansion pulses p1 and three or more contraction pulses p2 provided in the drive period Td (see FIG. 7B through FIG. 7D), for example, the following setting is made. In other words, when the plurality of expansion pulses p1 in the drive period Td include the final expansion pulse p1*e* and the plurality of anterior-stage expansion pulses (described above), and at the same time, the plurality of contraction pulses p2 in the drive period Td include the final contraction pulse p2*e* and the plurality of anterior-stage contraction pulses (described above), for example, the following setting is made.

That is, in the drive period Td, the pulse widths Wp1 in all of the expansion pulses p1 (all of the anterior-stage expansion pulses) other than at least the final expansion pulse p1*e* have respective values the same as each other. Similarly, in the drive period Td, the pulse widths Wp2 in all of the contraction pulses p2 (all of the anterior-stage contraction pulses) other than at least the final contraction pulse p2*e* have respective values the same as each other. It should be noted that, for example, it is possible for the pulse width Wp2 in first one of the contraction pulses p2 in the drive period Td to be different in value from the pulse width Wp2 in the rest of the contraction pulses p2.

[Operations and Functions/Advantages]

(A. Basic Operation of Printer 1)

In the printer 1, the recording operation (a printing operation) of images, characters, and so on to the recording paper P is performed in the following manner. It should be noted that as an initial state, it is assumed that the four types of ink tanks 3 (3Y, 3M, 3C, and 3K) shown in FIG. 1 are sufficiently filled with the ink 9 of the corresponding colors (the four colors), respectively. Further, there is achieved the state in which the inkjet heads 4 are filled with the ink 9 in the ink tanks 3 via the ink supply tubes 50, respectively.

In such an initial state, when operating the printer 1, the grid rollers 21 in the carrying mechanisms 2*a*, 2*b* each rotate to thereby carry the recording paper P along the carrying direction d (the X-axis direction) between the grid rollers 21 and the pinch rollers 22. Further, at the same time as such a carrying operation, the drive motor 633 in the drive mechanism 63 rotates each of the pulleys 631*a*, 631*b* to thereby operate the endless belt 632. Thus, the carriage 62 reciprocates along the width direction (the Y-axis direction) of the recording paper P while being guided by the guide rails 61*a*, 61*b*. Then, on this occasion, the four colors of ink 9 are appropriately ejected on the recording paper P by the respective inkjet heads 4 (4Y, 4M, 4C, and 4K) to thereby perform the recording operation of images, characters, and so on to the recording paper P.

(B. Detailed Operation in Inkjet Head 4)

Next, the detailed operation (the operation by the ejection drive) in the inkjet head 4 will be described.

First, in this inkjet head 4, the jet operation of the ink 9 using a shear mode is performed in the following manner. In other words, by the drive section 49 performing the ejection drive using the drive signal Sd described above on the actuator plate 42, the ink 9 filling the ejection channel C1*e* is ejected from the nozzle hole Hn.

When performing such ejection drive, the drive section 49 applies (see FIG. 2 through FIG. 4) the drive voltages Vd (the drive signals Sd) to the drive electrodes Ed (the common electrodes Edc and the individual electrodes Eda) inside the actuator plate 42. Specifically, the drive section 49 applies the drive voltage Vd to the drive electrodes Ed (the common electrodes Edc and the individual electrodes Eda) disposed on the pair of drive walls Wd constituting the ejection channel C1*e*. Thus, the pair of drive walls Wd each deform so as to protrude toward the non-ejection channel C1*d* adjacent to the ejection channel C1*e*.

On this occasion, it results in that the drive wall Wd makes a bending deformation to have a V shape centering on the intermediate position in the depth direction in the drive wall Wd. Further, due to such a bending deformation of the drive wall Wd, the ejection channel C1*e* deforms as if the ejection channel C1*e* bulges (see the expansion directions da shown in FIG. 4). As described above, due to the bending deformation caused by a piezoelectric thickness-shear effect in the pair of drive walls Wd, the volume of the ejection channel C1*e* increases. Further, by the volume of the ejection channel C1*e* increasing, the ink 9 is induced into the ejection channel C1*e* as a result.

Subsequently, the ink 9 having been induced into the ejection channel C1*e* in such a manner turns to a pressure wave to propagate to the inside of the ejection channel C1*e*. Then, the drive voltage Vd to be applied to the drive electrodes Ed becomes 0 (zero) V at the timing at which the pressure wave has reached the nozzle hole Hn of the nozzle plate 41 (or timing in the vicinity of that timing). Thus, the drive walls Wd are restored from the state of the bending deformation described above, and as a result, the volume of the ejection channel C1*e* having once increased is restored again (see the contraction directions db shown in FIG. 4).

In such a manner, the pressure in the ejection channel C1*e* increases in the process that the volume of the ejection channel C1*e* is restored, and thus, the ink 9 in the ejection channel C1*e* is pressurized. As a result, the ink 9 having shaped like a droplet is ejected (see FIG. 2 through FIG. 4) toward the outside (toward the recording paper P or the like) through the nozzle hole Hn. The jet operation (the ejection operation) of the ink 9 in the inkjet head 4 is performed in such a manner, and as a result, the recording operation (the printing operation) of images, characters, and so on to the recording paper P is performed.

(C. Operation State when Performing Common Drive)

Here, with reference to FIG. 9A through 9C, the operation state then performing the common drive (see FIG. 6B, and FIG. 7A through FIG. 7D) described above is as follows. FIG. 9A through FIG. 9C are each a diagram schematically showing an example of the operation state when the drive section 49 performs the common drive.

First, in the state shown in FIG. 9A, since the individual potential Vda fulfills Vda=0 and the common potential Vdc fulfills Vdc=0, the drive voltage Vd is set to Vd=0. Therefore, in this state, the volume V9 of the ejection channel C1*e* is set to a reference value (an initial value), and each of the drive walls Wd is also set to the initial state.

In contrast, in the state shown in FIG. 9), since the individual potential Vda fulfills Vda>0 and the common potential Vdc fulfills Vdc=0, the drive voltage Vd (=Vda−Vdc) is set to Vd>0. Therefore, as indicated by the dashed arrow in FIG. 9B, each of the drive walls Wd makes a bending deformation in the direction in which the volume V9 of the ejection channel C1*e* expands as a result.

Further, in the state shown in FIG. 9C, since the individual potential Vda fulfills Vda=0 and the common potential Vdc fulfills Vdc>0, the drive voltage Vd (=Vda−Vdc) is set to Vd<0. Therefore, as indicated by, for example, the dashed arrow in FIG. 9C, each of the drive walls Wd makes a bending deformation in the direction in which the volume V9 of the ejection channel C1*e* contracts as a result on the contrary to the state shown in FIG. 9B described above.

Further, by arbitrarily repeating such drive states shown in FIG. 9A through FIG. 9C, the common drive by the drive section 49 is performed, and as a result, the jet operation of the ink 9 is performed in such a manner as described above.

(D. Description of Ink 9 High in Viscosity)

Incidentally, in such an inkjet head 4, the jetting operation of the ink 9 is performed using, for example, the ink 9 high in viscosity in some cases. When using such ink 9 high in viscosity, a method of increasing the drive voltage Vd (making the drive voltage Vd high) in the drive signal Sd in proportion to the viscosity of the ink 9 is conceivable. However, in order to use the drive signal Sd having such a high voltage, there arises a necessity of changing the circuit configuration and so on of the drive section 49. Further, since the level of the drive voltage Vd has an upper limit value, there can arise a case when the ink 9 high in viscosity cannot be ejected depending on the conditions.

For this reason, there becomes necessary a method which does not require to apply the drive signal Sd high in voltage to, for example, the actuator plate 42 (does not require to change the circuit configuration and so on of the drive section 49) even when using the ink 9, for example, high in viscosity. In other words, there is required a proposal of a method of ensuring the ejection stability of the ink 9 even when jetting the ink 9 high in viscosity irrespective of the structure of the inkjet head 4.

(E. Drive Operation in the Present Embodiment)

Therefore, in the inkjet heads 4 according to the present embodiment, for example, it is arranged that the pulse widths in the variety of pulses included in the drive signal Sd are set within the predetermined numerical ranges described above (see FIG. 8). Further, in the inkjet heads 4 according to the present embodiment, it is arranged that when performing the common drive described above, for example, the timing at which the volume V9 of the ejection channel C1*e* (the pressure chamber) starts to change is set as follows.

(Description of Timing at which Volume V9 Starts to Change)

Figure 10A:
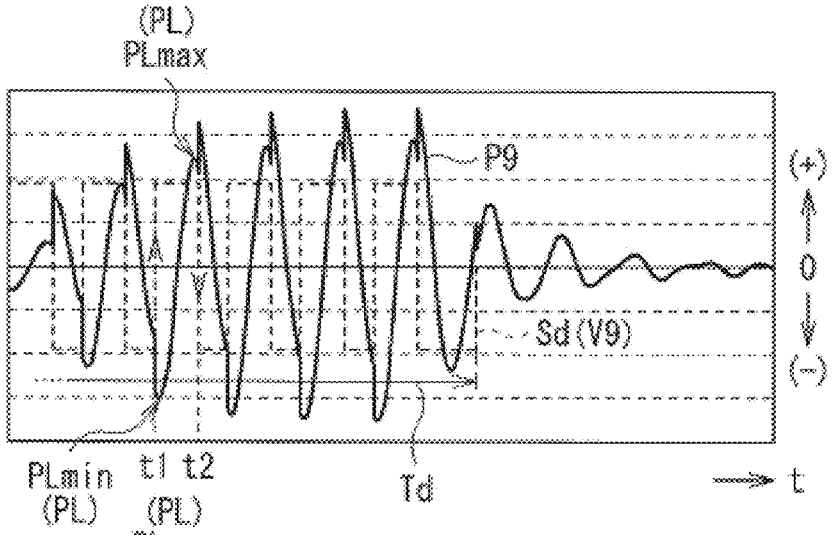
FIGS. 10A through 10C are timing charts schematically showing a variety of waveform examples related to Comparative Example 2 and Practical Examples 1, 2, respectively.
Figure 10B:
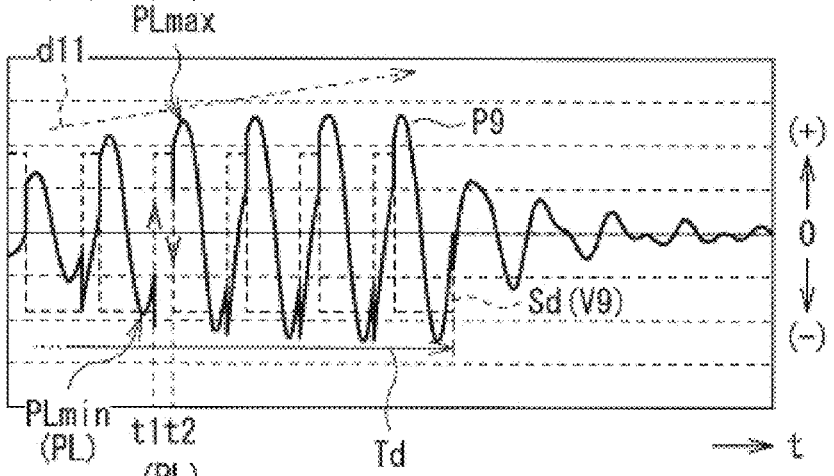
Figure 10C:
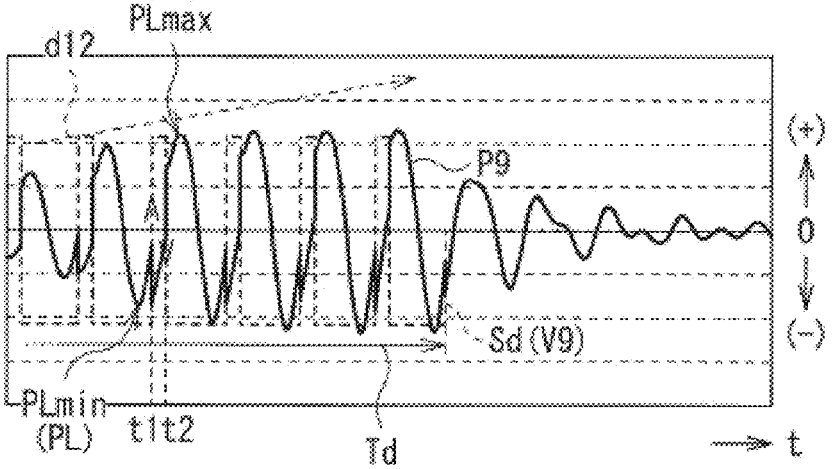

Here, FIG. 10A through FIG. 10C are timing charts schematically showing a variety of waveform examples related to Comparative Example 2 and Practical Examples 1, 2, respectively. Specifically, each of FIG. 10A through FIG. 10C is the timing chart schematically showing the waveform examples of the pressure P in the ejection channel C1*e* and the drive signal Sd (the volume V9 of the ejection channel C1*e*) as such a variety of waveform examples. Further, in the waveform examples of the drive signal Sd shown in FIG. 10A through FIG. 10C, unlike the waveform examples shown in FIG. 7A through FIG. 7D described above, the first pulse in the drive period Td is set to the expansion pulse p1 instead of the contraction pulse p2. It should be noted that in these drawings, the horizontal axis represents time t.

First, as shown in FIG. 10A through FIG. 10C, in any of Comparative Example 2, and Practical Examples 1, 2, the pressure P9 in the ejection channel C1*e* is arranged to change with time including a plurality of extremal values PL (a plurality of local maximum values PLmax and a plurality of local minimum values PLmin) within the drive period Td. Further, in any of Comparative Example 2 and Practical Examples 1, 2, the expansion start timing t1 described above and the contraction start timing t2 described above are adjacent to each other.

Here, in Practical Examples 1, 2 shown in FIG. 10B and FIG. 10C, it is arranged that both of the expansion start timing t1 and the contraction start timing t2 described above are located within a period between the two consecutive extremal values PL out of the plurality of extremal values described above with respect to the pressure P9. Specifically, in Practical Examples 1, 2 described above, both of the expansion start timing t1 and the contraction start timing t2 are located (see FIG. 10B and FIG. 10C) within the period of the change from the local minimum value PLmin to the local maximum value PLmax as the period between the two consecutive extremal values PL.

It should be noted that in contrast, in Comparative Example 2 shown in FIG. 10A, it is arranged that none of the expansion start timing t1 and the contraction start timing t2 is not located in the period (the period of the change from the local minimum value PLmin to the local maximum value PLmax) between the two consecutive extremal values PL described above. Specifically, for example, the expansion start timing t1 is located in a period anterior to the local minimum value PLmin, and the contraction start timing t2 is located in a period posterior to the local maximum value PLmax.

Further, in Practical Examples 1, 2 shown in FIG. 10B and FIG. 10C, last one of the plurality of local maximum values PLmax in the drive period Td is set the highest in the drive period Td. Further, the plurality of local maximum values PLmax change with time so as to increase in a stepwise manner (gradually) in the drive period Td (see the dashed arrows d11, d12 in FIG. 10B and FIG. 10C).

Further, in Practical Example 2 shown in FIG. 10C, the absolute value of the pressure P9 at the expansion start timing t1 is set smaller compared to the absolute value of the extremal value PL (the local minimum value PLmin in this example) immediately before the expansion start timing t1. It should be noted that in contrast, in Practical Example 1 shown in FIG. 10B, the absolute value of the pressure P9 at the expansion start timing t1 is set larger compared to the absolute value of the extremal value PL (the local minimum value PLmin in this example) immediately before the expansion start timing t1.

(F. Functions/Advantages)

In such inkjet heads 4 according to the present embodiment, for example, the following functions and advantages can be obtained.

(Description of Timing at which Volume V9 Starts to Change)

First, in the present embodiment, since both of the expansion start timing t1 and the contraction start timing t2 due to the expansion pulse p1 and the contraction pulse p2 in the drive signal Sd are located in the period between the two consecutive extremal values PL out of the plurality of extremal values PL with respect to the pressure P9 in the ejection channel C1*e* (see FIG. 10B and FIG. 10C), the following results compared to, for example, the case of Comparative Example 2 described above. That is, since both of the expansion start timing t1 and the contraction start timing t2 are located in such a period between the two consecutive extremal values PL, occurrence of an amplification phenomenon in the pressure P9 in the ejection channel C1*e* caused by the timings of the changes (expansion and contraction) of the volume V9 is avoided. Thus, it is possible to prevent bubbles from remaining in the ejection channel C1*e* by sucking in the bubbles due to the breakage of the meniscus caused by an excessive pressure change, and as a result, the deterioration of the ejection characteristics of the ink 9 is prevented. Therefore, it becomes unnecessary to apply the drive signal Sd high in voltage to, for example, the actuator plate 42 (to change the circuit configuration and so on of the drive section 49) even when using the ink 9, for example, high in viscosity. Therefore, in the present embodiment, it becomes possible to ensure the ejection stability of the ink 9 even when jetting the ink 9 high in viscosity irrespective of the structure of the inkjet head 4.

Further, in particular in the present embodiment, since both of the expansion start timing t1 and the contraction start timing t2 are located in the period of the change from the local minimum value PLmin to the local maximum value PLmax as the period between the two consecutive extremal values PL (see FIG. 10B and FIG. 10C), the occurrence of the amplification phenomenon of the pressure P9 described above becomes easy to avoid. As a result, it becomes easy to prevent the bubbles from remaining in the ejection channel C1*e* described above, and it becomes easy to prevent the deterioration of the ejection characteristics of the ink 9. Therefore, it becomes possible to make it easy to ensure the ejection stability of the ink 9 even when jetting the ink 9 high in viscosity.

Further, in the present embodiment, since the absolute value of the pressure P9 at the expansion start timing t1 is made smaller compared to the absolute value of the extremal value PL immediately before the expansion start timing t1 (see FIG. 10C), it results that the occurrence of the amplification phenomenon of the pressure P9 described above is more surely avoided. As a result, the bubbles are further prevented from remaining in the ejection channel C1*e* described above, and as a result, the deterioration of the ejection characteristics of the ink 9 is more surely prevented. Therefore, it becomes possible to more surely ensure the ejection stability of the ink 9 even when jetting the ink 9 high in viscosity.

In addition, in the present embodiment, since the plurality of expansion pulses p1 and the plurality of contraction pulses p2 are included in the drive period Td in the drive signal Sd, it results that a plurality of droplets are ejected from the nozzle hole Hn in the drive period Td. On this occasion, since last one of the plurality of local maximum values PLmax with respect to the pressure P9 is the highest in the drive period Td (see FIG. 10B and FIG. 10C), the following results therefrom. That is, the droplet ejected later catches up with the droplet ejected earlier to merge the droplets with each other, and as a result, the displacement in landing position of the plurality of droplets on the recording medium (the recording paper P) as the ejection target is suppressed. Therefore, it becomes possible to improve the printing quality when ejecting a plurality of droplets.

Further, in the present embodiment, since the plurality of local maximum values PLmax with respect to the pressure P9 change with time so as to increase in a stepwise manner in the drive period Td (see FIG. 10B and FIG. 10C), the following results therefrom. That is, when ejecting the plurality of droplets, mismatch of the pressure vibration is prevented, and it results that the displacement in landing position of the plurality of droplets described above is further suppressed. Therefore, it becomes possible to further improve the printing quality when ejecting a plurality of droplets.

Further, in the present embodiment, when arranging that first one of the plurality of pulses in the drive period Td is the contraction pulse p2 (see FIG. 7A through FIG. 7D) when the plurality of droplets are ejected from the nozzle hole Fin in the drive period Td in such a manner as described above, the following results therefrom. That is, the size of the droplet (a drop volume) increases to increase the ejection stability, and as a result, it becomes possible to improve the printing quality when ejecting a plurality of droplets.

(Description of Numerical Ranges of Pulse Widths in Various Pulses)

Further, in the present embodiment, since the pulse width Wp1 of at least one expansion pulse p1 (the anterior-stage expansion pulse described above) other than the final expansion pulse p1*e* in the drive period Td, and the pulse width Wp2 of at least one contraction pulse p2 (the anterior-stage contraction pulse described above) other than the final contraction pulse p2*e* in the drive period Td are set within the respective numerical ranges described above (see FIG. 8), the following results therefrom. That is, since the two types of pulse widths Wp1, Wp2 are set within the respective numerical ranges (0.2 AP≤Wp1≤1.0 AP, 1.0 AP≤Wp2≤1.8 AP) described above, the occurrence of the amplification phenomenon in the pressure P9 in the ejection channel C1*e* caused by the timings of the changes (expansion and contraction) of the volume V9 described above is avoided. Thus, the bubbles are prevented from remaining in the ejection channel C1*e* due to the excessive pressure change described above, and as a result, the deterioration of the ejection characteristics of the ink 9 is prevented, Therefore, it becomes unnecessary to apply the drive signal Sd high in voltage to, for example, the actuator plate 42 (to change the circuit configuration and so on of the drive section 49) even when using the ink 9, for example, high in viscosity. Therefore, in the present embodiment, it becomes possible to ensure the ejection stability of the ink 9 even when jetting the ink 9 high in viscosity irrespective of the structure of the inkjet head 4.

Further, in the present embodiment, since the pulse width Wp1*e* of the final expansion pulse p1*e* described above is set within the range of (0.2 AP≤Wp1*e*≤1.0 AP) (see FIG. 8), the following results therefrom. That is, first, since the final expansion pulse p1*e* is the pulse having the highest ratio of the contribution to the ejection speed of the ink 9 in the drive period Td, it becomes easy to adjust the ejection speed of the ink 9 by changing the pulse width Wp1*e* of the final expansion pulse p1*e*. Further, since the pulse width p1*e* of the final expansion pulse p1*e* is set within the numerical range described above (within the appropriate range), the ejection stability of the ink 9 becomes to be ensured compared to when being set out of the numerical range (Wp1*e*<0.2 AP, or 1.0 AP<Wp1*e*). Therefore, it becomes possible to easily perform the adjustment of the ejection speed of the ink 9 while ensuring the ejection stability of the ink 9 even when jetting the ink 9 high in viscosity.

In addition, in the present embodiment, since the pulse width Wp2*e* of the final contraction pulse p2*e* described above is set within the range of (0.5 AP≤Wp2*e*≤3.0 AP) (see FIG. 8), the following results therefrom. That is, first, the ink 9 is ejected at the timing of switching from the final expansion pulse p1*e* to the final contraction pulse p2*e* in the drive period Td, and the pressure change in the ejection channel C1*e* is gradually attenuated. Here, since it is possible to prevent such attenuation of the pressure change by adjusting the pulse width Wp2*e* of the final contraction pulse p2*e*, a harmful influence (an influence of the vibration) on the ejection of the ink 9 in the subsequent drive period Td is reduced in particular when ejecting the ink 9 with high frequency. Further, since the final contraction pulse p2*e* is the pulse having the highest ratio of the contribution to the generation of a satellite droplet (a small droplet) in the drive period Td, by the pulse width Wp2*e* of the final contraction pulse p2*e* being set within the numerical range (within the appropriate range) described above, the following results therefrom. That is, the generation of the satellite droplet is reduced compared to when being set out of the numerical range (Wp2*e*<0.5 AP, or 3.0 AP<Wp2*e*). Therefore, it becomes possible to more surely ensure the ejection stability of the ink 9 even when jetting the ink 9 high in viscosity.

Further, in the present embodiment, since the combined value (=Wp1+Wp2) of the pulse widths Wp1, Wp2 described above is set within the range of (2 AP±0.2 AP) (see FIG. 8), the following results therefrom. In other words, first, by the combined value being set within the range around 2 AP, it becomes easy for the ejection stability of the ink 9 described above to be ensured. Further, since the allowable range of (±0.2 AP) is set around 2 AP, it results that some shift (including the shift due to, for example, production tolerance) the combined value of the pulse widths Wp1, Wp2 described above is allowed. Therefore, it becomes possible to more surely ensure the ejection stability of the ink 9 even when jetting the ink 9 high in viscosity.

Further, in the present embodiment, when there are three or more expansion pulses p1 and three or more contraction pulses p2 provided in the drive period Td (see FIG. 7B through FIG. 7D), it results that three or more droplets are ejected from the nozzle hole Hn in the drive period Td. On this occasion, by the pulse widths Wp1 in all of the anterior-stage expansion pulses described above having the respective values the same as each other, and the pulse widths Wp2 in all of the anterior-stage contraction pulses described above having the respective values the same as each other, the following results therefrom. In other words, since it is possible to define each of these pulse widths Wp1, Wp2 with the minimum number of parameters based on the AP, it is possible to simplify waveform setting of the drive signal Sd when ejecting a plurality of droplets. Therefore, it becomes possible to improve the convenience when ejecting a plurality of droplets.

(G. Practical Examples)

Here, FIG. 11A through FIG. 11C, FIGS. 12A and 12B, and FIG. 13 are diagrams showing practical examples (Practical Examples 3-1 through 3-3, 4-1, 4-2, and 5) regarding the numerical ranges of the pulse widths in the variety of pulses described above when jetting the ink 9 high in viscosity, respectively. Specifically, FIG. 11A through FIG. 11C show the relationship between the pulse widths Wp1, Wp2 related to Practical Examples 3-1 through 3-3, and the ejection stability of the ink 9, respectively. Further, FIG. 12A and FIG. 12B show the relationship between the pulse widths Wp1, Wp2 related to Practical Examples 4-1 and 4-2, and the ejection stability of the ink 9, respectively. Further, FIG. 13 shows the relationship between the pulse width Wp2*e* and the offset voltage Vof (based on the AP) related to Practical Example 5, and the ejection stability of the ink 9. Incidentally, the offset voltage Vof means the amplitude of the drive voltage Vd necessary to obtain the ejection speed (a common value) of the ink 9 to be the reference.

It should be noted that in Practical Examples 3-1 through 3-3 shown in FIG. 11A through FIG. 11C, there are described examples of the waveform of the two drops (the 2-drop waveform) described above, a waveform of three drops (a 3-drop waveform), and a waveform of five drops (a 5-drop waveform), respectively. Further, in both of Practical Examples 4-1, 4-2 shown in FIG. 12A and FIG. 12B, there is described an example of the 5-drop waveform, and in Practical Example 5 shown in FIG. 13, there is described an example of a 1-drop waveform. Incidentally, the "1-drop (a single drop) waveform" is an example when a single expansion pulse p1 (and two contraction pulses p2) is included in the drive period Td. It should be noted that it is conceivable that substantially the same result can be obtained even when applying, for example, the "multi-pulse method" described above (when adopting the waveform of two or more drops) in Practical Example 5.

Further, in each of Practical Examples 3-1 through 3-3 shown in FIG. 11A through FIG. 11C, the combined value (=Wp1+Wp2) of the pulse widths Wp1, Wp2 is set as combinations of achieving 2 AP described above. In contrast, in Practical Example 4-1 shown in FIG. 12A, it is arranged that the pulse width Wp2 is fixed to Wp2=1.0 AP, and then the value of the pulse width Wp1 is made to gradually change. Similarly, in Practical Example 4-2 shown in FIG. 12B, on the contrary, it is arranged that the pulse width Wp1 is fixed to Wp1=1.0 AP, and then the value of the pulse width Wp2 is made to gradually change. It should be noted that Practical Examples 3-1 through 3-3, 4-1, 4-2, and 5 correspond to when the pulse width Wp2 in first one of the contraction pulses p2 in the drive period Td is different in value from the pulse width Wp2 in the rest of the contraction pulses p2 as described above.

Further, in the fields of the ejection stability shown in FIGS. 11A through 11C, FIGS. 12A and 12B, and FIG. 13, when the ejection stability is good is represented by "○(A)," and when the ejection stability is poor is represented by "×(B)." It should be noted that when the ejection stability cannot be measured is represented by "–."

Incidentally, the evaluation conditions for the ejection stability in the practical examples (Practical Examples 3-1 through 3-3, 4-1, 4-2, and 5) are as follows. It should be noted that it is arranged that the ejection stability is maintained even when, for example, gradually raising the value of the margin voltage described below. Further, in each of the practical examples described below, the evaluation of the ejection stability is performed in the case of the circulation type inkjet head described above.

(Evaluation Conditions)

- Drive voltage Vd: the voltage (the margin voltage) with which the ejection speed of the ink 9 becomes 7 (m/s)
- Nozzle holes Hn to be evaluated: a total of 384 nozzle holes Hn of a single-line type
- Ejection pattern: continuous ejection from all of the nozzle holes (the total of 384 nozzle holes described above)
- Drive frequency fd: 10 (kHz) as normal, arbitrarily changed with an upper limit of the drive current value
- Ejection time: for 30 seconds First, in any of Practical Examples 3-1 through 3-3 shown in FIG. 11A through FIG. 11C, when the pulse widths Wp1, Wp2 are set within the respective numerical ranges (0.2 AP≤Wp1≤1.0 AP, 1.0 AP≤Wp2≤1.8 AP) described above, the ejection stability is judged as good (○(A)). In contrast, when the pulse widths Wp1, Wp2 are set outside such numerical ranges (Wp1<0.2 AP or 1.0 AP<Wp1, Wp2<1.0 AP or 1.8 AP<Wp2), the ejection stability is judged as poor (×(B)) or unable to measure (–). According to the evaluation result of Practical Examples 3-1 through 3-3, it was confirmed that the ejection stability of the ink 9 is ensured even when jetting the ink 9 high in viscosity irrespective of the structure of the inkjet head 4 as described above when the pulse widths Wp1, Wp2 are set within the respective numerical ranges described above.

Further, in either of Practical Examples 4-1 and 4-2 shown in FIG. 12A and FIG. 12B, when the combined value (=Wp1+Wp2) of the pulse widths Wp1, Wp2 is set within the range of (2 AP±0.2 AP) described above, the following results therefrom. That is, when (1.8 AP≤(Wp1+Wp2)≤2.2 AP) is fulfilled, the ejection stability is judged as good (○(A)). In contrast, when the combined value of the pulse widths Wp1, Wp2 is set outside the range of (2 AP±0.2 AP), the following results therefrom. That is, when ((Wp1+Wp2) <1.8 AP) or (2.2 AP<(Wp1+Wp2)) is fulfilled, the ejection stability is judged as poor (×(B)). According to the evaluation result of Practical Examples 4-1 and 4-2, it was confirmed that the ejection stability of the ink 9 is more surely ensured even when jetting the ink 9 high in viscosity as described above when the combined value of the pulse widths Wp1, Wp2 is set within the range of (2 AP±0.2 AP).

Further, in Practical Example 5 shown in FIG. 13, when the pulse width Wp2*e* is set within the range of (0.5 AP≤Wp2*e*≤3.0 AP) described above, the ejection stability is judged as good (○(A)). In contrast, when the pulse width Wp2*e* is set outside the range of (0.5 AP≤Wp2*e*≤3.0 AP) (when Wp2*e*<0.5 AP is set in the example shown in FIG. 13), the ejection stability is judged as poor (×(B)). According to the evaluation result of Practical Example 5, it was confirmed that the ejection stability of the ink 9 is more surely ensured even when jetting the ink 9 high in viscosity as described above when the pulse width Wp2*e* is set within the range of (0.5 AP≤Wp2*e*≤3.0 AP).

2. Modified Examples

The present disclosure is described hereinabove citing the embodiment and the practical examples, but the present disclosure is not limited to the embodiment and so on, and a variety of modifications can be adopted.

For example, in the embodiment described above, the description is presented specifically citing the configuration examples (the shapes, the arrangements, the number and so on) of each of the members in the printer and the inkjet head, but those described in the above embodiment and so on are not limitations, and it is possible to adopt other shapes, arrangements, numbers and so on. Further, the values or the ranges, the magnitude relation and so on of a variety of parameters described in the above embodiment and so on are not limited to those described in the above embodiment and so on, but can also be other values or ranges, other magnitude relation and so on.

Specifically, for example, although in the embodiment and so on described above, the examples of the types, the number, the numerical ranges of the pulse widths, and so on of the pulses included in the drive signal Sd are specifically cited and described, those described in the embodiment and so on described above are not limitations, and other types, numbers, numerical ranges and so on of the pulse widths can also be adopted. Specifically, for example, the pulse widths in the plurality of pulses (the plurality of expansion pulses p1 and the plurality of contraction pulses p2) included in the drive signal Sd are not the same as each other, and can also be different from each other.

Further, as the structure of the inkjet head, it is possible to apply those of a variety of types. In other words, for example, in the embodiment and so on described above, the description is presented citing as an example a so-called side-shoot type inkjet head for ejecting the ink 9 from a central part in the extending direction of each of the ejection channels in the actuator plate. It should be noted that this example is not a limitation, and for example, it is possible to adopt a so-called edge-shoot type inkjet head for ejecting the ink 9 along the extending direction of each of the ejection channels.

Further, the type of the printer is not limited to the type described in the embodiment described above, and it is possible to apply a variety of types such as an MEMS (Micro Electro-Mechanical Systems) type.

Further, in the embodiment and so on described above, the description is presented citing the non-circulation type inkjet head described above and the circulation type inkjet head as an example, but it is possible to apply the present disclosure to the inkjet head of either of the types.

In addition, although in the embodiment and so on described above, the method of defining the timing at which the volume V9 of the pressure chamber starts to change, the method of defining the numerical ranges of the pulse widths of the variety of pulses included in the drive signal Sd, and so on are described citing the specific example, the methods cited in the embodiment and so on described above are not limitations, and it is possible to arrange to use other methods. Further, for example, it is also possible to arrange to use the two methods described above in combination as needed.

Further, the series of processes described in the above embodiment and so on can be arranged to be performed by hardware (a circuit), or can also be arranged to be performed by software (a program). In the case of arranging that the series of processes are performed by the software, the software is constituted by a program group for making the computer perform the functions. The programs can be incorporated in advance in the computer described above, and be then used, or can also be installed in the computer described above from a network or a recording medium and be then used.

Further, in the above embodiment, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange that the "liquid jet head" (the inkjet head) of the present disclosure is applied to other devices than the inkjet printer. Specifically, for example, it is also possible to arrange that the "liquid jet head" of the present disclosure is applied to a device such as a facsimile or an on-demand printer.

In addition, it is also possible to apply the variety of examples described hereinabove in arbitrary combination.

It should be noted that the advantages described in the specification are illustrative only but are not a limitation, and other advantages can also be provided.

Further, the present disclosure can also take the following configurations.

<1> A liquid jet head comprising: a plurality of nozzles configured to jet liquid; an actuator having a plurality of pressure chambers communicated individually with the nozzles, and each filled with the liquid; and a drive section configured to apply a drive signal having a plurality of pulses in one cycle to the actuator to thereby expand and contract a volume of the pressure chamber to jet the liquid filling the pressure chamber from the nozzle, wherein the plurality of pulses in the drive signal include: at least one first pulse configured to expand the volume of the pressure chamber; and at least one second pulse configured to contract the volume of the pressure chamber, pressure in the pressure chamber changes with time including a plurality of extremal values in the one cycle, first timing as expansion start timing of the volume of the pressure chamber by the first pulse and second timing as contraction start timing of the volume of the pressure chamber by the second pulse are adjacent to each other, and both of the first timing and the second timing are located in a period between two consecutive extremal values of the plurality of extremal values with respect to the pressure in the pressure chamber.

<2> The liquid jet head according to <1>, wherein both of the first timing and the second timing are located in a period of a change from a local minimum value to a local maximum value as the period between the two consecutive extremal values.

<3> The liquid jet head according to <1> or <2>, wherein an absolute value of the pressure in the pressure chamber at the first timing is made smaller compared to an absolute value of the extremal value immediately before the first timing.

<4> The liquid jet head according to any one of <1> to <3>, wherein the drive signal has a plurality of the first pulses and a plurality of the second pulses in the one cycle, the plurality of extremal values with respect to the pressure in the pressure chamber include a plurality of local maximum values in the one cycle, and last one of the plurality of local maximum values is highest in the one cycle.

<5> The liquid jet head according to <4>, wherein the plurality of local maximum values with respect to the pressure in the pressure chamber change with time so as to increase in a stepwise manner in the one cycle.

<6> The liquid jet head according to any one of <1> to <5>, wherein the drive signal has a plurality of the first pulses and a plurality of the second pulses in the one cycle, and first one of the plurality of pulses in the one cycle is set as the second pulse.

<7> A liquid jet recording device comprising the liquid jet head according to any one of <1> to <6>.

What is claimed is:

1. A liquid jet head comprising:

a plurality of nozzles configured to jet liquid;

an actuator having a plurality of pressure chambers communicated individually with the nozzles, and each filled with the liquid; and a drive section configured to apply a drive signal having a plurality of pulses in one cycle to the actuator to thereby expand and contract a volume of the pressure chamber to jet the liquid filling the pressure chamber from the nozzle, wherein the plurality of pulses in the drive signal include:

at least one first pulse configured to expand the volume of the pressure chamber, the first pulse having a first pulse start and a first pulse end; and at least one second pulse configured to contract the volume of the pressure chamber, the second pulse having a second pulse start and a second pulse end, pressure in the pressure chamber changes with time including a plurality of extremal values in the one cycle, first timing as expansion start timing of the volume of the pressure chamber by the first pulse and second timing as contraction start timing of the volume of the pressure chamber by the second pulse are adjacent to each other, and both of the first timing and the second timing are located in a period between two consecutive extremal values of the plurality of extremal values with respect to the pressure in the pressure chamber, wherein both of the first timing and the second timing are located in a period of a change from a local minimum value to a local maximum value as the period between the two consecutive extremal values, the pressure in the pressure chamber continues to increase up to the local maximum value, even after increasing the pressure in the pressure chamber due to the second pulse, the pressure in the pressure chamber reaches the local minimum value and begins to increase after reaching the local minimum value during the second pulse and prior to the second pulse end, wherein the first pulse end occurs at the same time as the second pulse start, and wherein the second pulse end occurs at the same time as a first pulse start in a subsequent cycle.

2. The liquid jet head according to claim 1, wherein an absolute value of the pressure in the pressure chamber at the first timing is made smaller compared to an absolute value of the extremal value immediately before the first timing.

3. The liquid jet head according to claim 1, wherein the drive signal has a plurality of the first pulses and a plurality of the second pulses in the one cycle, the plurality of extremal values with respect to the pressure in the pressure chamber include a plurality of local maximum values in the one cycle, and last one of the plurality of local maximum values is highest in the one cycle.

4. The liquid jet head according to claim 3, wherein the plurality of local maximum values with respect to the pressure in the pressure chamber change with time so as to increase in a stepwise manner in the one cycle.

5. The liquid jet head according to claim 1, wherein the drive signal has a plurality of the first pulses and a plurality of the second pulses in the one cycle, and first one of the plurality of pulses in the one cycle is set as the second pulse.

6. A liquid jet recording device comprising the liquid jet head according to claim 1.

7. The liquid jet head according to claim 1, wherein a length of the first pulse is shorter than a length of the second pulse.

* * * * *